US011554567B2

(12) United States Patent
Troppmann

(10) Patent No.: US 11,554,567 B2
(45) Date of Patent: Jan. 17, 2023

(54) HAND PRESS FOR PRESSING A PACKAGING

(71) Applicant: Hubert Troppmann, Pyhra (AT)

(72) Inventor: Hubert Troppmann, Pyhra (AT)

( * ) Notice: Subject to any disclaimer, the term of this patent is extended or adjusted under 35 U.S.C. 154(b) by 0 days.

(21) Appl. No.: 17/041,244

(22) PCT Filed: Mar. 27, 2018

(86) PCT No.: PCT/EP2018/057748
§ 371 (c)(1),
(2) Date: Sep. 24, 2020

(87) PCT Pub. No.: WO2019/185120
PCT Pub. Date: Oct. 3, 2019

(65) Prior Publication Data

US 2021/0101353 A1 Apr. 8, 2021

(51) Int. Cl.
*B30B 9/32* (2006.01)
*B30B 15/32* (2006.01)

(52) U.S. Cl.
CPC ..... *B30B 9/323* (2013.01); *B30B 15/32* (2013.01)

(58) Field of Classification Search
CPC ... B30B 9/3042; B30B 9/3082; B30B 9/3053; B30B 9/323; B30B 9/301; B30B 9/3021; B30B 15/32; B30B 1/04; Y01S 100/902
USPC ..... 100/233, 228.229 A, 902
See application file for complete search history.

(56) References Cited

U.S. PATENT DOCUMENTS

| | | | | | |
|---|---|---|---|---|---|
| 2,665,632 | A * | 1/1954 | Kawa | B02C 1/00 | 100/233 |
| 5,611,270 | A * | 3/1997 | Harrington | B30B 9/323 | 100/102 |
| 2011/0061548 | A1* | 3/2011 | Monteith | B30B 9/323 | 100/102 |
| 2018/0194554 | A1* | 7/2018 | Cole | B30B 9/325 | 100/102 |

FOREIGN PATENT DOCUMENTS

| | | | | |
|---|---|---|---|---|
| JP | H0531598 A | * | 2/1993 | B30B 9/32 |
| JP | H05104292 A | * | 4/1993 | B30B 9/32 |
| JP | H07204900 A | * | 8/1995 | B30B 9/32 |
| JP | H11-77391 | | 3/1999 | |

(Continued)

OTHER PUBLICATIONS

International Search Report and Written Opinion for International (PCT) Patent Application No. PCT/EP2018/057748, dated Feb. 4, 2019, 15 pages.

(Continued)

*Primary Examiner* — Adam J Eiseman
*Assistant Examiner* — Matthew Stephens
(74) *Attorney, Agent, or Firm* — Sheridan Ross P.C.

(57) ABSTRACT

The invention relates to a hand press for pressing a package, the hand press having a housing, which has at least one first opening for the inserting the package and at least one second opening for the disposing of the package. Furthermore, the hand press has a pressing device, which is arranged essentially inside the housing and which has a first pressing surface, and an actuating device, which is connected via a rotary shaft with at least one lever, which is rotatably mounted with the pressing device.

20 Claims, 8 Drawing Sheets

(56) References Cited

FOREIGN PATENT DOCUMENTS

| | | |
|---|---|---|
| JP | 3060659 | 9/1999 |
| WO | WO 93/04956 | 3/1993 |

OTHER PUBLICATIONS

Translation of the International Search Report for European Patent Application No. PCT/EP2018/057748, dated Feb. 4, 2019, 2 pages.
Translation of the International Preliminary Report on Patentability for International (PCT) Patent Application No. PCT/EP2018/057748, dated Feb. 4, 2019, 7 pages.

* cited by examiner

HAND PRESS FOR PRESSING A PACKAGING

CROSS REFERENCE TO RELATED APPLICATIONS

This application is a national stage application under 35 U.S.C. 371 and claims the benefit of PCT Application No. PCT/EP2018/057748 having an international filing date of 27 Mar. 2018, which designated the United States, the disclosure of which is incorporated herein by reference in its entirety.

The invention relates to a hand press for pressing a packaging, and in particular it relates to a hand press for pressing a food packaging.

For the efforts to further improve climate protection, an efficient collection, storage or also transport of used packaging, especially food packaging such as PET bottles or plastic containers, beverage cans, other metal packaging, composite and cardboard packaging is advantageous.

In this context, the object of the invention is to improve the pressing of packaging.

This problem is solved by a hand press for pressing a packaging according to the claim 1.

A hand press according to the invention for pressing a package, preferably a food packaging, more preferably a bottle or can, comprises a housing having at least one first opening for the insertion of the package and at least one second opening for the disposal of the package. Furthermore, the hand press comprises a pressing device, which is arranged essentially inside the housing and which has a first pressing surface, and an actuating device, which is connected via a rotation shaft to at least one lever, which is rotatably mounted with the pressing device.

Furthermore, the hand press has a flap device, which is arranged essentially inside the housing and which comprises a first part for closing the first opening of the housing and a second part having a second pressing surface The flap device can be fixed by the pressing device in at least two positions, whereby in at least one starting position the packaging is held by the first part at least partially in the area of the first opening, and in at least one pressing position the first opening is at least partially closed by the first part, and the first and second pressing surfaces form a wedge-shaped pressing space, so that the packaging is brought into the housing during the transition from the starting position to the pressing position, it is at least partially held and compressible in the pressing position in the region of the tip of the wedge-shaped pressing space by the first and second pressing surfaces, and it can be ejected from the housing through the second opening during a subsequent transition from the pressing position to the starting position.

Furthermore, the pressing device can be moved during the transition from the starting position to the pressing position in such a way that the angle of the wedge-shaped pressing chamber is reduced and the pressing device is guided in a predetermined radial curved path by at least one journal arranged on the pressing device.

One aspect of the invention is based on the approach of pressing waste, which in uncompressed form requires a large surface area or space, in a simple manner by means of a hand press, so that a pressing force caused by the leverage effect of the hand press according to the invention is exerted on the packaging with the least possible muscular effort, so that it can be brought into a form compressed as possible. Thus, a space-saving storage of the waste can be already be made possible during the storage of the waste, for example in a waste sack or in a waste bin.

In addition, more waste can be transported to a collection point such as a landfill within a transport container even if this waste is transported to a collection point at a later date, while the size of the transport container remains the same. Furthermore, the collection point requires less space to store the waste produced.

In a preferred embodiment, the first pressing surface is curved and/or angled towards the second pressing surface in the area of the tip of the wedge-shaped pressing chamber. This arrangement ensures, that the risk of the packaging slipping when it is inside the wedge-shaped pressing chamber is reduced or prevented, in particular by slipping through the second opening of the housing.

In another preferred embodiment, the cam track is set up in such a way, so that the pressing device rotates more in a first area of the cam track than in a second area of the cam track when the journal traverses. This arrangement ensures that any shifting, in particular sliding up, of the packaging to be compacted during the pressing process is reduced to a greater extent and the pressing surfaces are thus preferably arranged almost parallel, in particular parallel, to each other when the packaging is more highly compacted.

In another preferred embodiment, the radial center of the cam track does not correspond to the axial center of the rotary shaft. This means that the lever action, which occurs when the actuating device is actuated, is transferred to the pressing device with a greater force. Thus, less force is required for the pressing process.

In another preferred embodiment, the journal has at least one roller, which is guided in the cam track. This reduces the frictional resistance of the roller of the journal within the cam track, so that the hand press needs not much maintenance in this respect.

In another preferred embodiment, the surface of the first and/or second pressing surface is at least partially uneven and/or has an anti-slip structure. This makes it possible to reduce or to prevent the packaging to be compacted from the shifting, especially from sliding up, when a force is applied to the pressing device and thus during the pressing process.

In another preferred embodiment, the second pressing surface is limited in the pressing position by at least one mechanical stop. Thus, a shift in the position of the pressing device due to an excessive force, which can lead to a damage of the components of the hand press, is limited in a simple way, so that the hand press is more reliable in operation.

In another preferred embodiment, the actuating device and the lever can be fixed non-rotatably at a predetermined angle to each other. This allows the lever action to be adjusted with the same force applied by the actuating device so that the hand press can be individually configured depending on the height of the hand press or the size of a user of the hand press.

In another preferred embodiment, the flap device is rotatably mounted in the transition area between the first part and the second part. This allows an easy movement of the flap device, so that the flap device can be transferred from the starting position to the pressing position and vice versa with little force.

In a further embodiment, the press device is reset automatically. This means that after the pressing process, the actuating device can be easily returned to its starting position without any additional force being applied by a user of the hand press.

In another preferred embodiment, the housing is arranged on a holding device, in particular on a height-adjustable holding device. This enables the hand press to be independent of the specifications, especially the height, of a waste container, which can be connected in particular to the second opening of the housing, so that a package compacted with the hand press enters the waste container when it exits from the second opening of the housing.

In another preferred embodiment, a tilting device is arranged at the holding device, by means of which the housing can be tilted from a horizontal position of use to an emptying position inclined to the horizontal. This makes it easier to empty or to change the waste container, as the container can be removed when the hand press is tilted away from the waste container without having to move the hand press to another position.

In another preferred embodiment, the housing can be locked on the holding device and/or the tilting device. This prevents the housing from being removed from the hand press, especially inadvertently or deliberately. The preferred embodiment reduces or prevents the risk of injury that could result from removing the housing during the operation of the hand press.

In another preferred embodiment, a fastening device is arranged on the housing, to which a waste container, in particular a waste bin, can be attached, so that the second opening of the housing leads into the waste container. This makes it easy to mount the waste container so that it can be permanently attached to the housing to accommodate compacted packaging.

Further features, advantages and possible applications of the invention are set out in the following description in connection with the figures in which the same reference signs are used throughout for the same or corresponding elements of the invention. It shows at least partially schematically:

Figure 1:
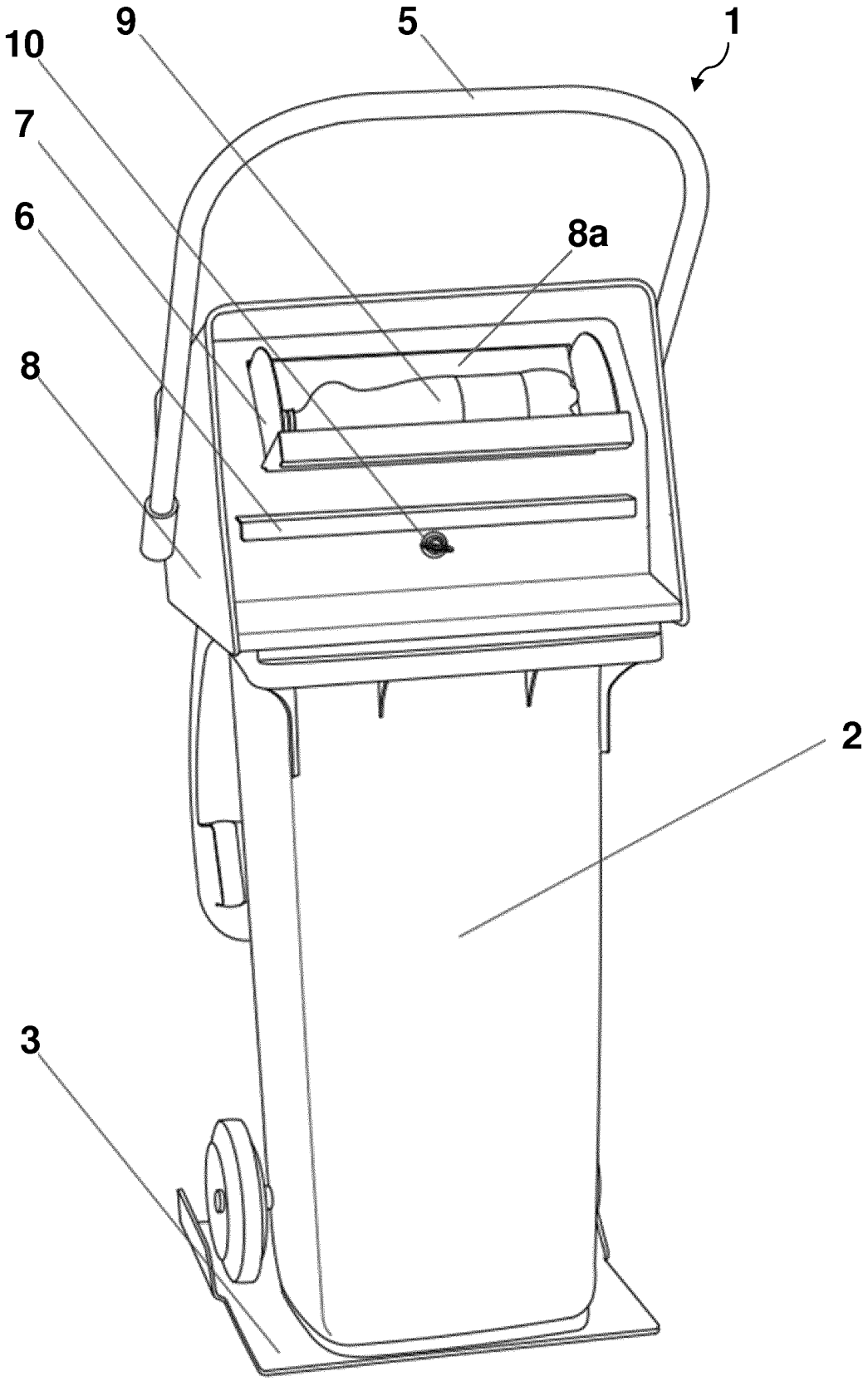
FIG. 1 is a first embodiment of a hand press according to the invention.

FIG. 1 shows a first embodiment of a hand press 1 according to the invention. The hand press 1 has a housing 8, which is arranged on a waste container 2. This waste container 2 is in turn arranged on a base plate 3.

The housing 8 is equipped with an actuating device 5, which in this embodiment is constructed as a hand lever. A packaging 9, in particular, as shown in this embodiment, a PET bottle, is arranged in or at a first opening 8*a* of the housing 8, whereby a second part 7*b* of a flap device 7 prevents the packaging 9 from entering into the housing 8.

In addition, the housing 8 has a locking device 10 with a locking bracket 6, so that the hand press 1 can be locked. A more detailed illustration of this arrangement is shown in the FIGS. 6 and 7.

In general, the hand press 1 can be integrated for or into various disposal systems. Due to the safe, lockable and hygienic features of the hand press 1, a maintenance-free handling of the hand press 1 is possible.

Figure 2:
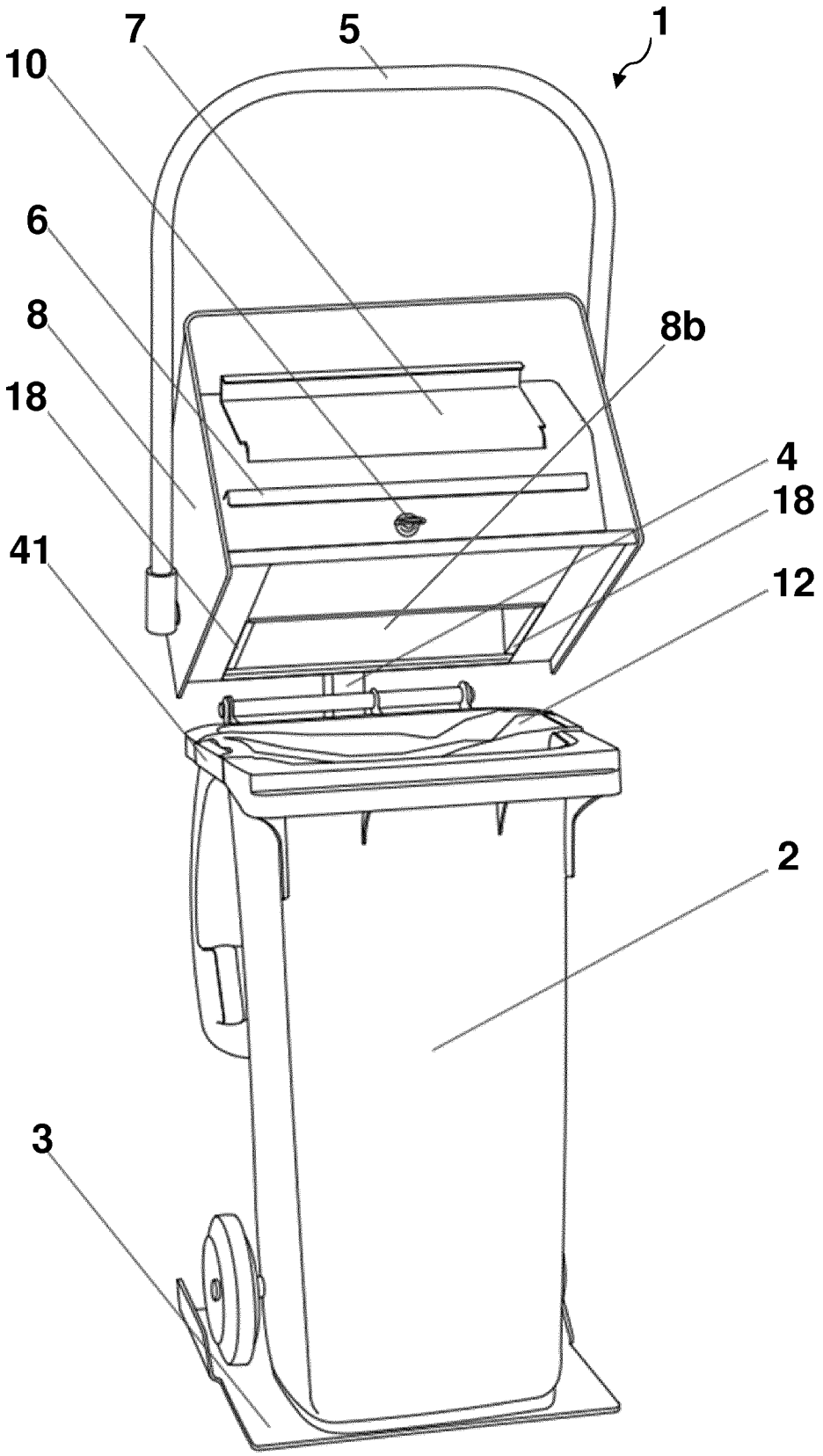
FIG. 2 is a second embodiment of a hand press according to the invention.

FIG. 2 shows a second embodiment of the hand press 1 according to the invention. In this illustration, the housing 8 is tilted backwards, so that the waste container 2 can be emptied or replaced. For this purpose, the housing 8 is mounted on a holding device 4, which is preferably connected to the base plate 3, or a tilting device 23 is mounted on the holding device 4, by means of which the housing 8 can be tilted from a horizontal position of use into an emptying position inclined to the horizontal. This tilting device 23 can also be locked or barred by means of the locking device 10 or the blocking bracket 6, so that an accidental or even willful tilting of the housing 8 can be prevented. Thus, the housing 8 can be removed or detached from the waste bin 2, so that the housing 8 can only be removed from the waste bin 2 by means of a tilting movement.

Furthermore, in this illustration, the first opening 8*a* of the housing 8 is closed by means of the first part 7*a* of the flap device 7, so that no packaging 9 can be placed in the housing 8. It also reduces or minimizes the risk that a user enters a body part into the housing 8 through the first opening 8*a* while using the hand press 1.

A second opening 8*b* of the housing 8 is also visible, which when the housing 8 is in the position of use, as shown in the FIG. 1, leads to the inside of the waste bin 2. In this embodiment, a waste bag 12 is inside the waste bin 2. Furthermore, a holder 41 is on the waste bin 2, which is preferably used to clamp a waste bag 12 in the waste bin 2. The configuration of the hand press 1 makes it possible to integrate it into existing collection systems without restricting the functionality of previously used waste containers 2.

Figure 3:
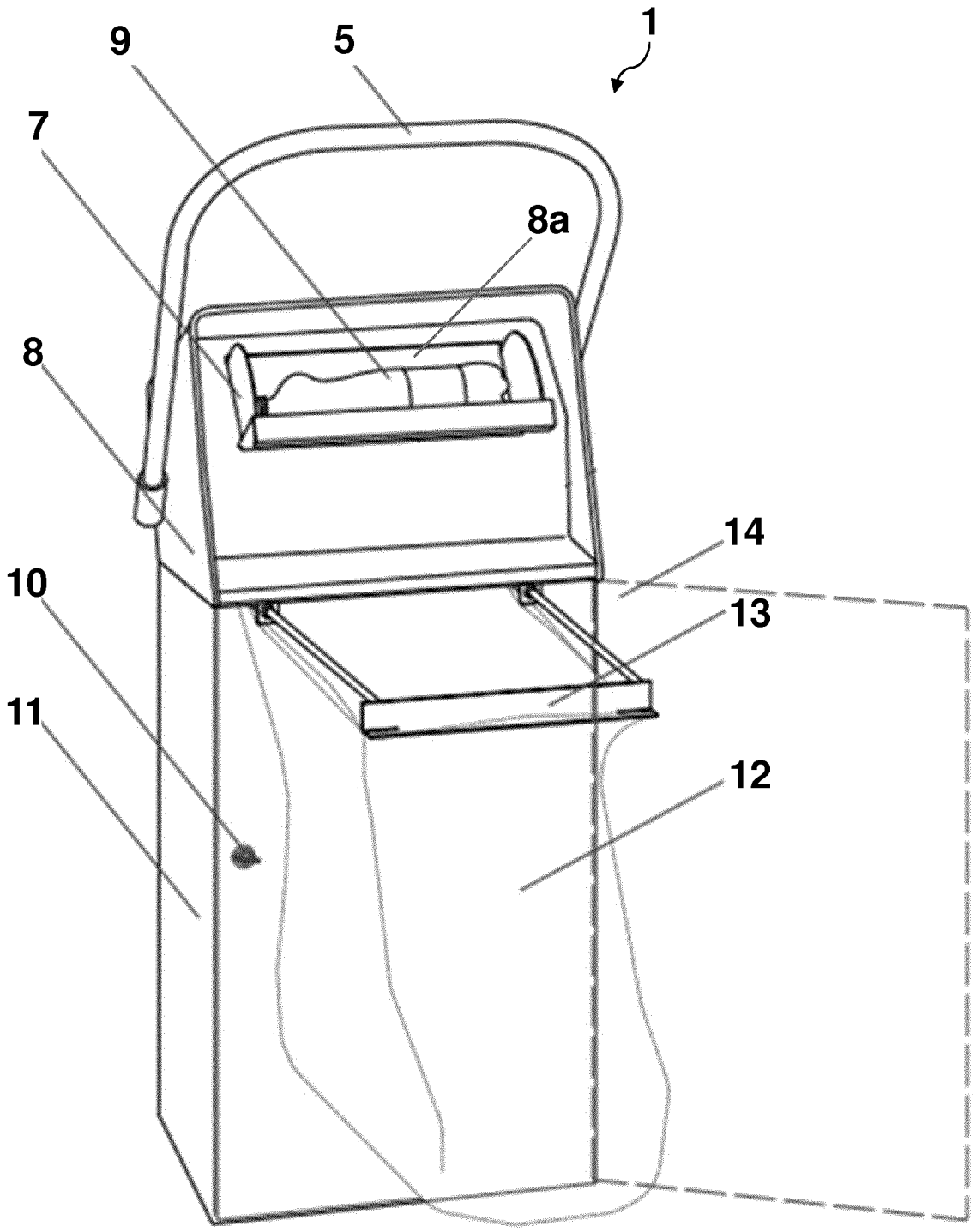
FIG. 3 is a third embodiment of a hand press according to the invention.

FIG. 3 shows a third embodiment of the hand press 1 according to the invention. In this illustration, a pull-out fastening device 13 is arranged on the housing 8, to which a waste container 2, in particular a waste bag 12 can be fastened, so that the second opening 8*b* of the housing 8 leads into the waste container 2, when the housing 2 is in the position of use. In addition, a chamber 11 is arranged below the housing 8, in which the waste container 2 is located, preferably during operation of the hand press 1. This chamber 8 can be closed by means of a door 14, which can be locked by means of the lock 10.

Figure 4:
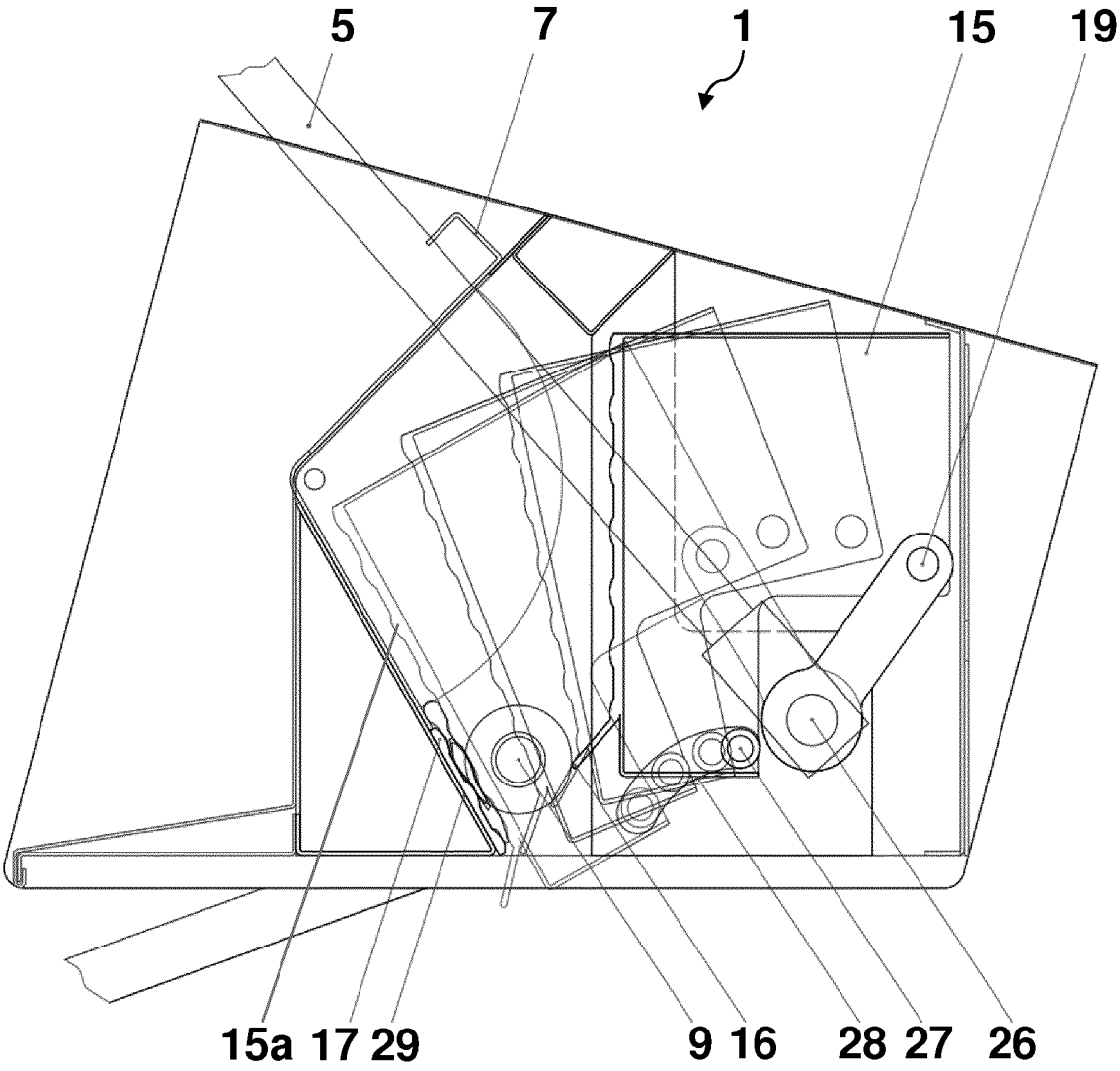
FIG. 4 is a fourth embodiment of a hand press according to the invention.

FIG. 4 shows a fourth embodiment of the hand press 1 according to the invention. This illustration shows a cross section of the housing 8, with the various devices of the hand press 1 shown in different positions. In particular, the transition of the flap device 7 from a starting position to a pressing position is shown, whereby two further intermediate positions are visible.

The actuating device 5, which is configured as a hand lever, leads to a rotation shaft 26, which is connected to a leaver 19, whereby this lever 19 is rotatably mounted with a pressing device 15. Preferably, the actuating device 5 and the lever 19 can be fixed non-rotatably at a predetermined angle to each other.

The pressing device 15 arranged on the lever 19 has a first pressing surface 15*a*, whereby this forms a wedge-shaped pressing space 42 with a second pressing surface 7*b* of the flap device 7, which represents the second part of the flap device 7. In the lower part of this wedge shaped pressing chamber 42 is a package 9, in particular, as shown in this example, a PET bottle which is at least partially held by the first pressing surface 15*a* and the second pressing surface 7*b* in the area of the tip of the wedge-shaped pressing chamber 42. By actuating the actuating device 5 by pressing the actuating device 5 downwards, a force effect is transmitted via the rotary shaft 26 to the lever 19, causing the pressing device 15 to tilt or move to the left in this illustration. As explained in more detail in the FIG. 5, this also moves the flap device 7 in such a way that the first part 7*a* of the flap device 7 at least partially closes the first opening 8*a* of the housing 8, and the package 9 is compressed between the first pressing surface 15*a* and the second pressing surface 7*b*.

Due to this mechanical movement of the pressing device 15 during the transition from the starting position to the pressing position, the angle of the wedge-shaped pressing chamber 42 is reduced. Furthermore, the pressing device 15 has at least one journal 27 arranged on the pressing device 15, which is guided in a, particular predetermined, radial cam track 28. This arrangement ensures in particular that the pressing device 15 rotates more strongly in a first area of the cam track 28 than in a second area of the cam track 28 when passing through the journal 27, so that the first pressing surface 15*a* and second pressing surface 7*b* in the pressing position are almost parallel, in particular parallel, to each other. Preferably on both sides of the actuating device 5, the lever 19 is arranged, which is arranged on the rotation shaft 26 and which is rotatably mounted with the pressing device 15.

An improved compaction performance is achieved by this double lever action, which can be achieved with the arrangement of the journal 27 according to the invention in conjunction with the position of the lever pivot points on the pressing device 15. This double lever action increases as the package 9 to be further compacted slides down in the pressing chamber 42. On the one hand, the manual force of the user is introduced into the package 9 to be compacted via the pressing device 15 via the lever 19, which acts as an angle lever, and on the other hand, the pressing device 15 is supported on the cam track 28 via the journal 27 during the entire feed movement, so that the pressing device 15, as a one-sided lever, additionally increases the manual force of the user even further.

In the lower part of the tip of the wedge-shaped pressing chamber, the first pressing surface 15*a* is preferably curved and/or angled towards the second pressing surface 7*b*. As can be seen in the FIG. 4, this ensures that the packaging 9 can not slip through the pressing chamber 42 without being compressed. Furthermore, the second pressing surface 7*b* oft the flap device 7 is preferably limited in the pressing position by at least one mechanical stop 29, so that an overpressing of the actuating device 5 is reduced or prevented. In addition, a pressure plate 17 is located in the area of the tip of the wedge-shaped pressing chamber 42, which is also used as a pressure surface for the second pressing surface.

Figure 5:
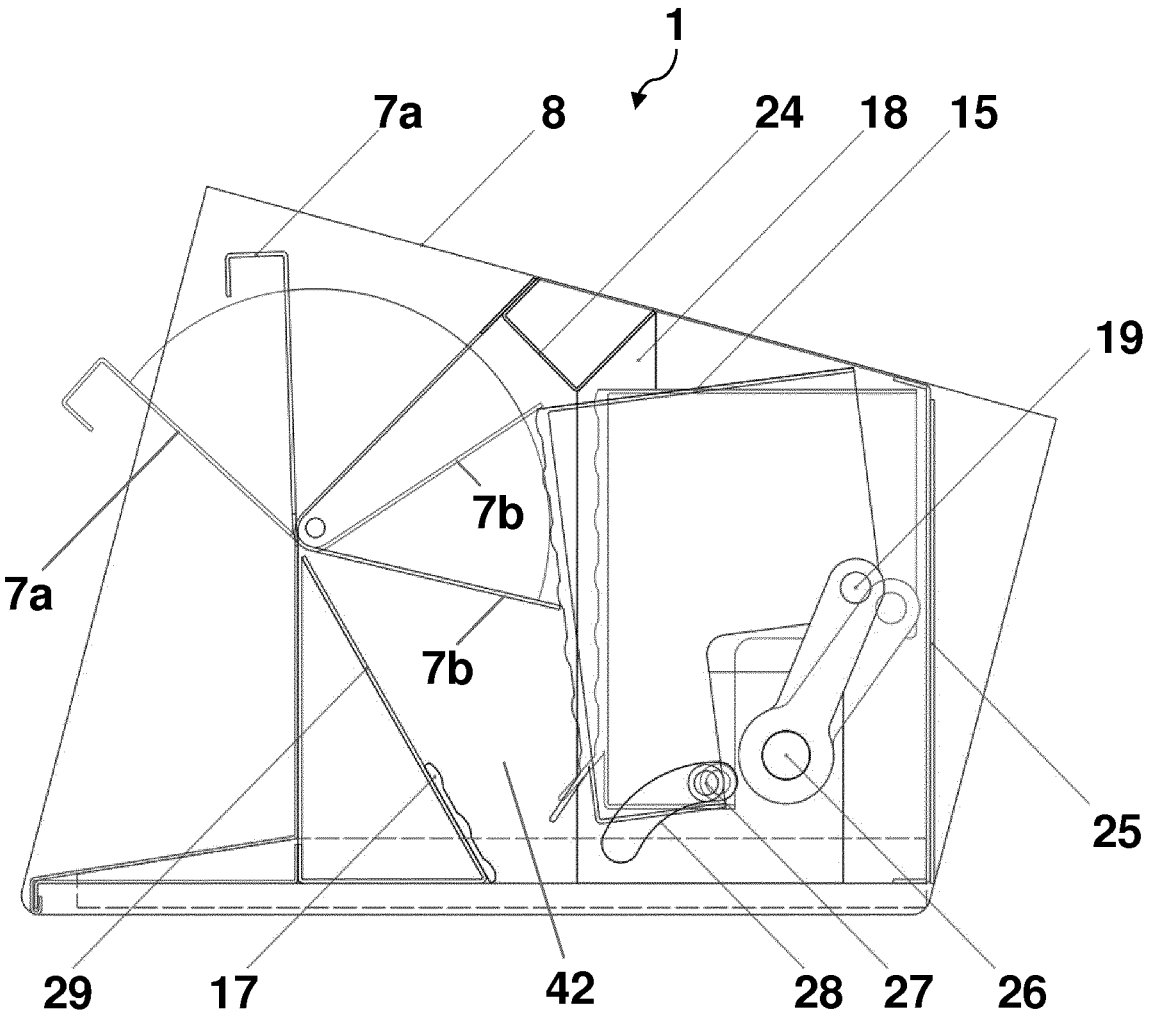
FIG. 5 is a fifth embodiment of a hand press according to the invention.

FIG. 5 shows a fifth embodiment of hand press 1 according to the invention. The essentially Z-shaped flap device 7 is shown in this illustration in two different positions.

In a first position, the first part 7*a* of the flap device 7 is partially arranged outside the housing 8 so that a package 9 can be inserted into the first opening 8*a* of the housing 8, the position of the flap device 7 preventing the package 9 from moving downwards because the second pressing surface 7*b* of the flap device 7 is inclined upwards.

If the actuating device 5, which is not shown in this illustration, is pressed downwards, the pressing device 15 is tilted or moved to the left, whereby the flap device 7 rotates clockwise as indicated by the circled section. The first pressing surface 15*a* contacts the second pressing surface 7*b* in such a way that the second pressing surface 7*b* is also moved due to the rotary movement of the pressing device 15.

Thus, due to the double function of the flap device 7 on the one hand to transport the packaging 9 into the pressing chamber 42, and on the other hand to use the second part of the flap device 7 as a second pressing surface 7*b* when the first opening 8*a* of the housing is closed, it is no longer possible to open the pressing chamber 42 again during the pressing process, or that it is opened. In addition, the pressing chamber 42 is also not accessible for placing the packaging 9 at the first opening 8*a* of the housing 8. The flap device 7 remains blocked—for example in the case of a willful actuation of the actuating device 5 by a person for filling the pressing chamber by the pressing device 15 moving the pressing chamber 42. In addition, the first part 7*a* of the flap device 7 also blocks any movement of the pressing device 15 during the opening of the first opening 8*a* of the housing 8.

As can be seen in this illustration, the radial center of the cam track 28 does not correspond to the axial center of the rotation shaft 26. Furthermore, the journal 27 preferably has at least one roller, which is guided in the cam track 28.

Furthermore, the first pressing surface 15*a* and the second pressing surface 7*b* are preferably at least partially uneven and/or have an anti-slip structure. Likewise, the actuating device 5 is mechanically blocked in the opposite direction, as the lever 19 can not be turned any further due to the rear wall of the housing 25.

Additional devices for stripping from the wedged packaging 9 are the pressing-device guides 18 projecting from the side of the housing 8 and a pressing-space cover plate 24 located just above the pressing-device 15.

In summary, the package 9, which enters into the housing 8 via the first opening 8*a*, can be compacted by means of the flap device 7 and the pressing device 15, and when it passes from the pressing position to the starting position of the flap device 7, it can leave the housing 8 via the second opening 8*b*, so that the package 9 preferably enters the waste container 2.

Figure 6:
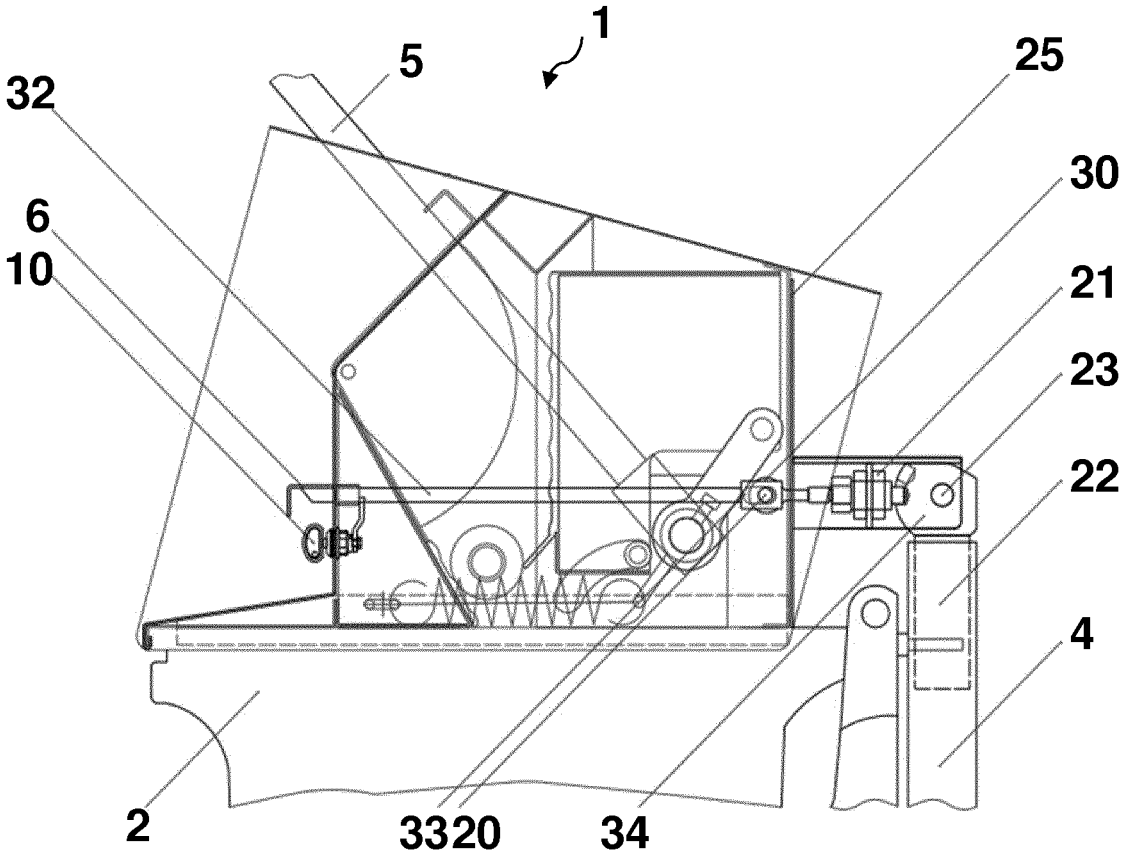
FIG. 6 is a sixth embodiment of a hand press according to the invention.

FIG. 6 shows a sixth embodiment of the hand press 1 according to the invention. The hand press 1 is preferably in flush and thus can be arranged hygienically on the waste container 2, whereby the hand press 1 is rotatably connected to the holding device 4 via the holding device 4 on the rear side together with the tilting device 23, which in this illustration is constructed as a support hinge. A difference in height of the waste bin 2 can be compensated for by a height-adjustable latching piece 34. On the tilting device 23, there is a locking pin 21, which is engaged during the operation of the hand press 1. In this position the tilting device 23 blocks the lifting of the hand press 1, and it thus prevents the removal of waste container 2.

In order to be able to unlock the locking pin 21, a locking pin drive 20 leads centrally into the interior of the housing 8 and is then guided out of the housing 8 again via a crossbar. Two tie rods 32 connected to the locking brackets 6 lead from the front side of the housing 8 to this cross rod. An adjustable connecting piece 30 closes the force flow on both sides from the locking pin 21 to the locking brackets 6.

The locking bracket 6 is additionally equipped with a locking pin in the middle, which is guided into the housing 8 via a guide tube connected to the front side of the housing 8. The locking device 10 is mounted below this central pin guide, which, after unlocking, enables the housing 8 to be folded up by pulling out the locking bow 6. The locking pin 21 is spring-loaded and re-engages in the desired position after the housing 8 has been folded up. The latching piece 34 on the tilting device 23 is constructed in such a way that, in the case of wall mounting 40, the housing 8 cannot come into contact with the wall. During disposal of the housing 9, the latching pin 21 can be locked again for safety reasons. In order to ensure the stability of the hand press 1, the hand press 1 can or must be detachably connected to the floor or the rear wall.

Figure 7:
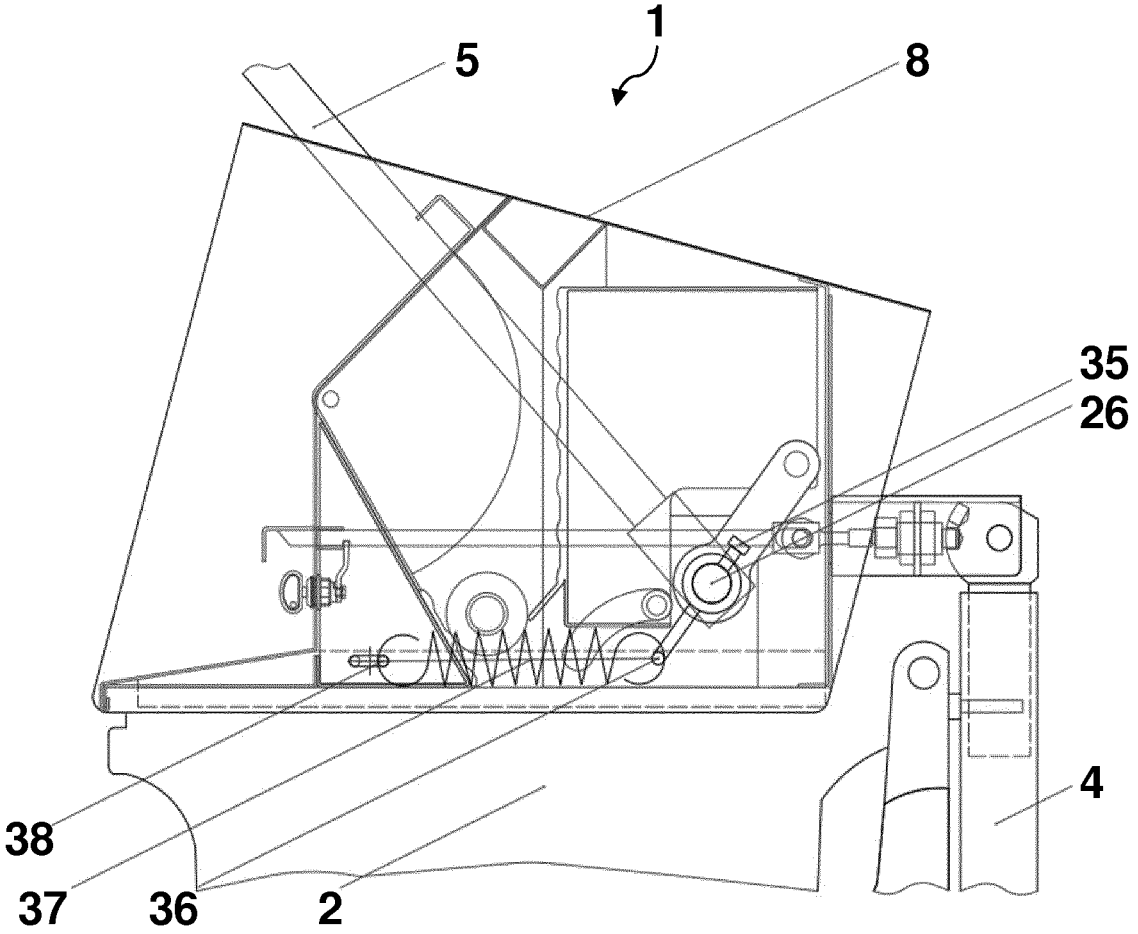
FIG. 7 is a seventh embodiment of a hand press according to the invention.

FIG. 7 shows a seventh embodiment of the hand press 1 according to the invention. As already explained, the actuating device 5 transfers the user's hand force via a preferably detachable screw connection to the rotary shaft 26, from which it is passed via the lever 19 to the pressing device 15. The resetting of the pressing device 15 takes place automatically via at least one spring device 37, here two spring devices 37. Retaining rings 35 attached to the rotary shaft 26 outside the housing 8 are adjustably connected to a spring device 37 each via a tensioning lever 36. A respective tension spring holder 38 is attached to the housing 8.

Figure 8A:
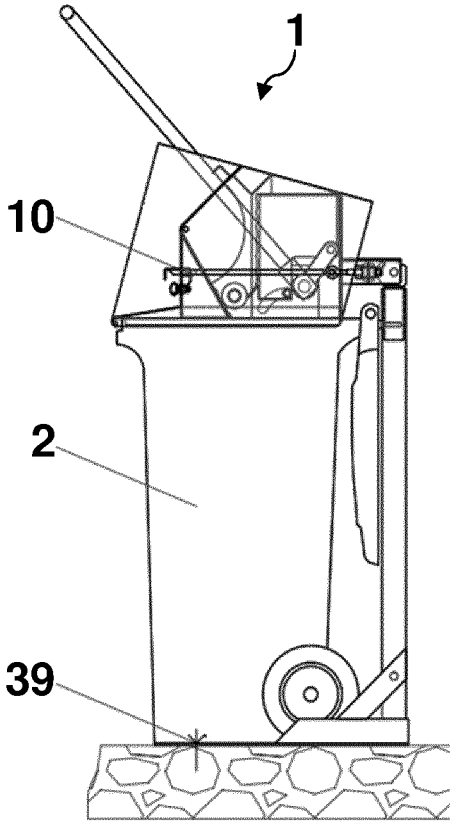
FIG. 8*a* and FIG. 8*b* summarize an eighth embodiment of a hand press according to the invention.
Figure 8B:
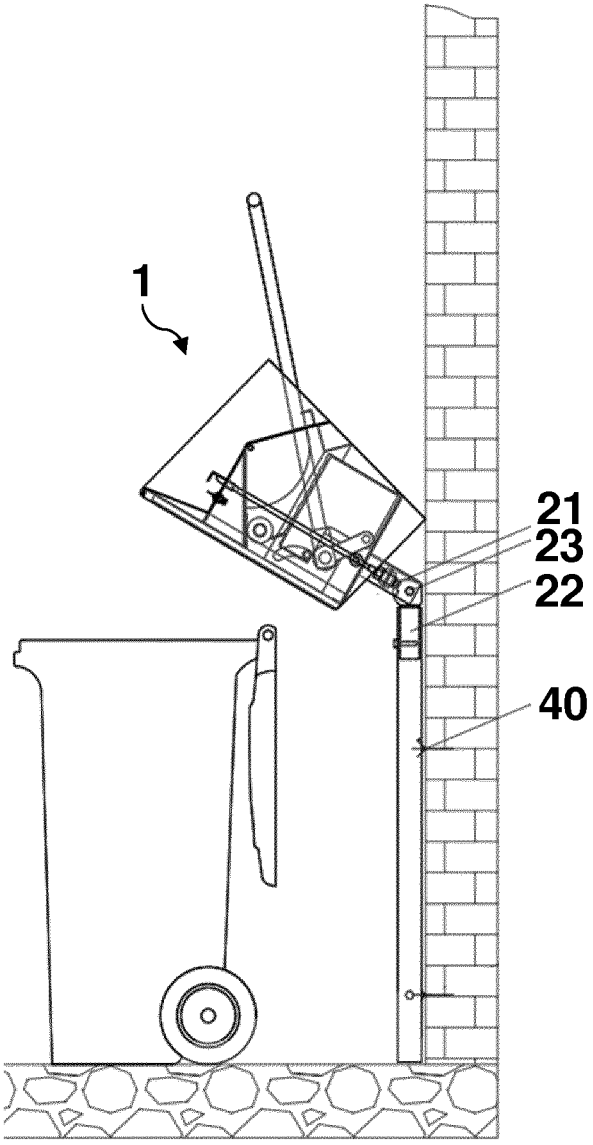

FIG. 8*a* and FIG. 8*b* show an eighth embodiment of the hand press according to the invention 1. As can be seen in the FIG. 8*a*, the hand press 1 can be arranged freely floating as a floor mounting 39 on or above a waste container 2 or, as shown in the FIG. 8*b*, it can be arranged on a wall as wall mounting 40.

LIST OF REFERENCE SIGNS

1 hand press
2 waste bins
3 base plate
4 holding device
5 actuating device
6 locking brackets
7 flap device
7*a* first part of the flap device
7*b* second pressing surface
8 housing
8*a* first opening
8*b* second opening
9 packaging
10 locking
11 chamber
12 waste sack
13 fastening device
14 door
15 pressing device
15*a* first pressing surface
16 angled or curved area of the first pressing surface
17 pressure plate
18 press facility device
19 levers
20 locking pin drive
21 locking pin
22 height-adjustable snap-in piece
23 tilting device
24 press room end plate
25 housing rear panel
26 rotating shaft
27 journal
28 curved track
29 mechanical stop
30 connecting piece
31 hinge
32 drawbar
33 adjusting screw
34 snap-in piece
35 retaining ring
36 clamping lever
37 spring device
38 extension spring bracket
39 floor mounting
40 wall mounting
41 holder
42 pressing space

The invention claimed is:

1. A hand press for pressing a packaging and configured to be mounted on a waste container, the hand press comprising:

a housing, which has at least one first opening for inserting the packaging and at least one second opening for disposing of the packaging;

a pressing device, which is arranged inside the housing and which has a first pressing surface;

an actuating device, which is connected via a rotary shaft to at least one lever which is rotatably supported by the pressing device; and a flap device, which is arranged within the housing and which has a first part for closing the at least one first opening of the housing and a second part with a second pressing surface, wherein the flap device is configured to be fixed in at least two positions by the pressing device, wherein, in at least one starting position of the at least two positions, the flap device is configured to be positioned such that the packaging is held at least partially in the region of the at least one first opening by the first part, wherein, in at least one pressing position of the at least two positions, the flap device is configured to be positioned such that the at least one first opening is at least partially closed by the first part of the flap device, and the second pressing surface of the flap device forms a wedge-shaped pressing space with the first pressing surface of the pressing device, wherein the flap device is configured such that the packaging is brought into the housing during a transition from the at least one starting position into the at least one pressing position, wherein the flap device is configured such that in the pressing position the packaging is at least partially held by the first pressing surface and the second pressing surface, wherein the first pressing surface and the second pressing surface are configured to be pressed together in the at least one pressing position in a region of a tip of the wedge-shaped pressing space by the first pressing surface and the second pressing surface, wherein the flap device is configured such that transitioning from the at least one pressing position into the at least one starting position ejects the packaging from the housing through the at least one second opening, wherein the pressing device is configured to be moved during the transition from the at least one starting position into the at least one pressing position in such a way that an angle of the wedge-shaped pressing space is reduced and that the pressing device is guided in a predetermined radial curved path by means of at least one journal arranged on the pressing device, and wherein the flap device is rotatably mounted in a transition region between the first part and the second part.

2. The hand press according to claim 1, wherein the first pressing surface is curved and/or angled towards the second pressing surface in the region of the tip of the wedge-shaped pressing space.

3. The hand press according to claim 1, wherein the predetermined radial curved path is set up in such a way that the pressing device rotates more strongly when traversing the at least one journal in a first region of the predetermined radial curved path than in a second region of the predetermined radial curved path.

4. The hand press according to claim 1, wherein a radial center of the predetermined radial curved path does not correspond to a center point of the rotary shaft.

5. The hand press according to claim 1, wherein the at least one journal has at least one roller, which is guided in the predetermined radial curved path.

6. The hand press according to claim 1, wherein a surface of the first pressing surface and/or a surface of the second pressing surface is uneven.

7. The hand press according to claim 1, wherein the second pressing surface in the at least one pressing position is limited by at least one mechanical stop.

8. The hand press according to claim 1, wherein the actuating device and the at least one lever is configured to be fixed non-rotatably at a predetermined angle to each other.

9. The hand press according to claim 1, wherein the housing is arranged on a holding device.

10. The hand press according to claim 9, wherein a tilting device is arranged on the holding device, and wherein via the tilting device the housing is configured to be tilted from a horizontal use position into an emptying position inclined relative to the horizontal use position.

11. The hand press according to claim 10, wherein the housing is configured to be locked to the holding device and/or the tilting device such that the housing may not be removed from the hand press.

12. The hand press of claim 1, wherein a fastening device is arranged on the housing, and wherein the fastening device is configured to be fastened to the waste container so that the at least one second opening of the housing leads into the waste container.

13. The hand press according to claim 1, wherein a surface of the first pressing surface and/or a surface of the second pressing surface has a slip-inhibiting structure.

14. A hand press for pressing a packaging, comprising:

a housing, which has at least one first opening for inserting the packaging and at least one second opening for disposing of the packaging;

a pressing device, which is arranged inside the housing and which has a first pressing surface;

an actuating device, which is connected via a rotary shaft to at least one lever which is rotatably supported by the pressing device; and a flap device, which is arranged within the housing and which has a first part for closing the at least one first opening of the housing and a second part with a second pressing surface, wherein the flap device is configured to be fixed in at least two positions by the pressing device, wherein, in at least one starting position of the at least two positions, the flap device is configured such that any of the packaging is held in the region of the at least one first opening by the first part, wherein, in at least one pressing position of the at least two positions, the flap device is configured such that the first part of the flap device closes any of the at least one first opening and the second pressing surface of the flap device forms a wedge-shaped pressing space with the first pressing surface of the pressing device, wherein the flap device is configured such that the packaging is brought into the housing during a transition from the at least one starting position into the at least one pressing position, wherein the flap device is configured such that in the pressing position any of the packaging is held by the first pressing surface and the second pressing surface, wherein the flap device is configured such that the first pressing surface and the second pressing surface are pressed together in the at least one pressing position in a region of a tip of the wedge-shaped pressing space by the first pressing surface and the second pressing surface, wherein the flap device is configured such that transitioning from the at least one pressing position into the at least one starting position ejects the packaging from the housing through the at least one second opening, wherein the pressing device is configured to be moved during the transition from the at least one starting position into the at least one pressing position in such a way that an angle of the wedge-shaped pressing space is reduced and that the pressing device is guided in a predetermined radial curved path by means of at least one journal arranged on the pressing device, and wherein the at least one journal has at least one roller, which is guided in the predetermined radial curved path.

15. The hand press according to claim 14, wherein the first pressing surface is curved and/or angled towards the second pressing surface in the region of the tip of the wedge-shaped pressing space.

16. The hand press according to claim 14, wherein the predetermined radial curved path is set up in such a way that the pressing device rotates more strongly when traversing the at least one journal in a first region of the predetermined radial curved path than in a second region of the predetermined radial curved path.

17. The hand press according to claim 14, wherein a radial center of the predetermined radial curved path does not correspond to a center point of the rotary shaft.

18. The hand press according to claim 14, wherein a surface of the first pressing surface and/or a surface of the second pressing surface is uneven.

19. A hand press for pressing a packaging and configured to be mounted on a waste container, the hand press comprising:

a holding device;

a housing, which has at least one first opening for inserting the packaging and at least one second opening for disposing of the packaging;

a tilting device arranged on the holding device, wherein the tilting device is arranged between the housing and the holding device, and wherein via the tilting device the housing is configured to be tilted from a horizontal use position into an emptying position inclined relative to the horizontal use position;

a pressing device, which is arranged inside the housing and which has a first pressing surface;

an actuating device, which is connected via a rotary shaft to at least one lever which is rotatably supported by the pressing device; and a flap device, which is arranged within the housing and which has a first part for closing the at least one first opening of the housing and a second part with a second pressing surface, wherein the flap device is configured to be fixed in at least two positions by the pressing device, wherein, in at least one starting position of the at least two positions, the flap device is configured such that the packaging is held in the region of the at least one first opening by the first part, wherein, in at least one pressing position of the at least two positions, the flap device is configured such that the first part of the flap device at least partially closes the at least one first opening and the second pressing surface of the flap device forms a wedge-shaped pressing space with the first pressing surface of the pressing device, wherein the flap device is configured such that the packaging is brought into the housing during a transition from the at least one starting position into the at least one pressing position, wherein the flap device is configured such that in the pressing position the packaging is at least partially held by the first pressing surface and the second pressing surface, wherein the flap device is configured such that the first pressing surface and the second pressing surface are pressed together in the at least one pressing position in a region of a tip of the wedge-shaped pressing space by the first pressing surface and the second pressing surface, wherein the flap device is configured such that transitioning from the at least one pressing position into the at least one starting position ejects the packaging from the housing through the at least one second opening, wherein the pressing device is configured to be moved during the transition from the at least one starting position into the at least one pressing position in such a way that an angle of the wedge-shaped pressing space is reduced and that the pressing device is guided in a predetermined radial curved path by means of at least one journal arranged on the pressing device.

20. The hand press according to claim 19, wherein the at least one journal has at least one roller, which is guided in the predetermined radial curved path.

* * * * *